US009082537B2

(12) United States Patent
Hashimoto et al.

(10) Patent No.: US 9,082,537 B2
(45) Date of Patent: Jul. 14, 2015

(54) R-T-B BASED PERMANENT MAGNET

(71) Applicant: TDK CORPORATION, Tokyo (JP)

(72) Inventors: Ryuji Hashimoto, Tokyo (JP); Kenichi Suzuki, Tokyo (JP); Kyung-ku Choi, Tokyo (JP); Kenichi Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/262,156

(22) Filed: Apr. 25, 2014

(65) Prior Publication Data

US 2014/0320246 A1 Oct. 30, 2014

(30) Foreign Application Priority Data

Apr. 25, 2013 (JP) ..... 2013-092235

(51) Int. Cl.
*H01F 1/057* (2006.01)
*H01F 10/12* (2006.01)

(52) U.S. Cl.
CPC ..... *H01F 1/057* (2013.01); *H01F 10/126* (2013.01)

(58) Field of Classification Search
CPC ..... H01F 1/057; H01F 10/126
USPC ..... 148/101
IPC ..... H01F 1/0577, 41/026, 1/0578
See application file for complete search history.

(56) References Cited

U.S. PATENT DOCUMENTS

| | | | | |
|---|---|---|---|---|
| 4,770,723 | A | 9/1988 | Sagawa et al. | |
| 5,089,065 | A | 2/1992 | Hamano et al. | |
| 2003/0079805 | A1 | 5/2003 | Hamada et al. | |
| 2008/0050581 | A1 * | 2/2008 | Miwa et al. | 428/332 |
| 2008/0054738 | A1 | 3/2008 | Komuro et al. | |
| 2008/0241368 | A1 | 10/2008 | Komuro et al. | |
| 2008/0241513 | A1 | 10/2008 | Komuro et al. | |
| 2013/0093551 | A1 | 4/2013 | Peng et al. | |
| 2013/0135069 | A1 | 5/2013 | Miyamoto et al. | |
| 2014/0320243 | A1 | 10/2014 | Hashimoto et al. | |
| 2014/0320244 | A1 | 10/2014 | Hashimoto et al. | |
| 2014/0320245 | A1 | 10/2014 | Hashimoto et al. | |

FOREIGN PATENT DOCUMENTS

| | | | |
|---|---|---|---|
| JP | 59-46008 | | 3/1984 |
| JP | H-06-942 | B2 | 1/1994 |
| JP | H-06-2930 | B2 | 1/1994 |
| JP | H-06-6776 | B2 | 1/1994 |
| JP | H-06-112026 | A | 4/1994 |
| JP | 2005-286152 | A | 10/2005 |
| JP | A-2008-60183 | | 3/2008 |
| JP | 2008-263208 | A | 10/2008 |
| JP | A-2008-266767 | | 11/2008 |
| JP | A-2008-270699 | | 11/2008 |
| JP | A-2011-187624 | | 9/2011 |
| JP | A-2012-39100 | | 2/2012 |
| JP | A-2012-043968 | | 3/2012 |
| JP | 53-70609 | B1 | 9/2013 |
| WO | 2012003702 | A1 | 1/2012 |

OTHER PUBLICATIONS

May 20, 2014 Decision for Granting a Patent in Japanese Patent Application No. JP2013-092235 w/transiation.
May 20, 2014 Decision for Granting a Patent issued in Japanese Application No. JP2013-092236.
Jul. 28, 2014 Office Action issued in U.S. Appl. No. 14/257,206.
Dec. 15, 2014 Office Action issued in U.S. Appl. No. 14/261,516.
Uehara, Minoru. "Microstructure and Permanent Magnet Properties of a Perpendicular Anisotropic NdFeB/Ta Multilayered Thin Film Prepared by Magnetron Sputtering." Journal of Magnetism and Magnetic Materials. 284. pp. 281-286. (2004).
Nov. 14, 2014 Office Action issued in U.S. Appl. No. 14/257,541.
May 20, 2014 Decision for Granting a Patent issued in Japanese Patent Application No. 2013-092238.
Mar. 11, 2014 Office Action issued in Japanese Patent Application No. 2013-092236.
Nov. 20, 2014 Office Action issued in U.S. Appl. No. 14/257,206.
Apr. 6, 2015 Office Action issued in U.S. Appl. No. 14/261,516.

* cited by examiner

*Primary Examiner* — Weiping Zhu
(74) *Attorney, Agent, or Firm* — Oliff PLC

(57) ABSTRACT

The present invention provides a permanent magnet which is excellent in the temperature properties and the magnetic properties of which will not be significantly decreased, compared to the conventional R-T-B based permanent magnet. In the R-T-B based structure, a stacked structure of R1-T-B based crystal layer and Y-T-B based crystal layer can be formed by alternatively stacking R1-T-B and Y-T-B. In this way, a high magnetic anisotropy field of the R1-T-B based crystal layer can be maintained while the temperature coefficient of the Y-T-B based crystal layer can be improved.

20 Claims, 1 Drawing Sheet

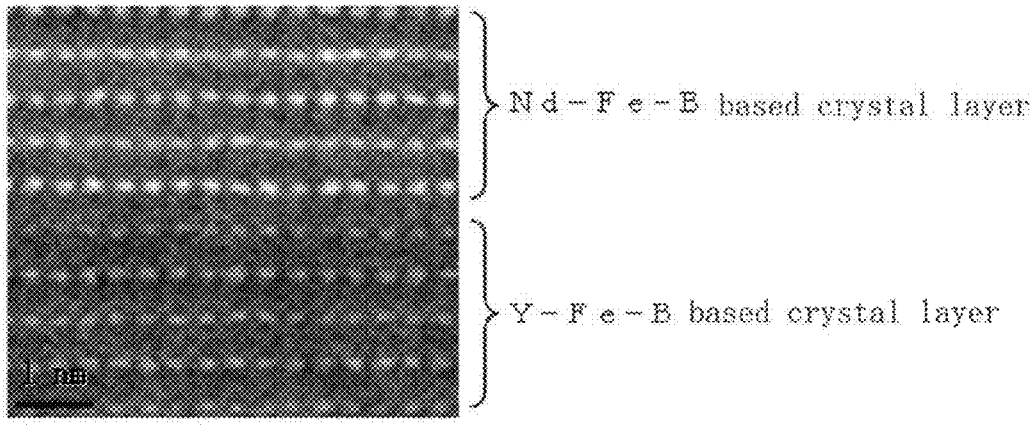
Nd-Fe-B based crystal layer
Y-Fe-B based crystal layer
1 nm

R-T-B BASED PERMANENT MAGNET

The present invention relates to a rare earth based permanent magnet, especially a permanent magnet obtained by selectively replacing part of the R in the R-T-B based permanent magnet with Y.

BACKGROUND

The R-T-B based permanent magnet (R represents a rare earth element, and T represents Fe or Fe with part of it replaced by Co) comprising a tetragonal compound $R_2T_{14}B$ as the major phase is known to have excellent magnetic properties, and has been considered as a representative permanent magnet with good performances since it was invented in 1982 (Patent Document 1: JPS9-46008).

In particular, the R-T-B based permanent magnets in which the rare earth element R consists of Nd, Pr, Dy, Ho or Tb have large magnetic anisotropy fields Ha, and are widely used as permanent magnet materials. Of those, the Nd—Fe—B based permanent magnet having Nd as the rare earth element R is widely used in people's livelihood, industries, transportation equipment and the like, because it has a good balance among saturation magnetization Is, curie temperature Tc and magnetic anisotropy field Ha, and is better in resource volume and corrosion resistance than the R-T-B based permanent magnets with other rare earth elements R. However, the Nd—Fe—B based permanent magnet has some problems. In particular, the absolute value of the temperature coefficient of the residual flux density is large, and only a small magnetic flux can be achieved especially under a high temperature above 100° C. compared to that under room temperature.

PATENT DOCUMENTS

Patent Document 1: Japanese Laid-Open Patent Publication No. Sho 59-46008

Patent Document 2: Japanese Laid-Open Patent Publication No. 2011-187624

Y is known as a rare earth element that has smaller absolute values of the temperature coefficients of residual flux density and coercivity than those of Nd, Pr, Dy, Ho and Tb. The Patent Document 2 has disclosed a Y-T-B based permanent magnet having Y as the rare earth element R in the R-T-B based permanent magnet. Although the Y-T-B based permanent magnet contains $Y_2Fe_{14}B$ phase having a small magnetic anisotropy field Ha as the major phase, a permanent magnet with a practical coercivity can be achieved by increasing the amounts of Y and B to levels larger than those based on the stoichiometric composition of $Y_2Fe_{14}B$. Further, by using Y as the rare earth element R in the R-T-B based permanent magnet, a permanent magnet with smaller absolute values of the temperature coefficients of residual flux density and coercivity than those of the Nd—Fe—B based permanent magnet can be achieved. However, the Y-T-B based permanent magnet disclosed in Patent Document 2 has a residual flux density of about 0.5 to 0.6 T, a coercivity of about 250 to 350 kA/m and magnetic properties much worse than those of the Nd-T-B based permanent magnet. That is, the Y-T-B based permanent magnet described in Patent Document 2 can hardly replace the conventional Nd-T-B based permanent magnet.

SUMMARY

The present invention is achieved by recognizing the above-mentioned situation. It is an object of the present invention to provide a permanent magnet with excellent temperature properties and magnetic properties that will not significantly deteriorate even under a high temperature above 100° C., compared to the R-T-B based permanent magnet widely used in people's livelihood, industries, transportation equipment and the like.

To solve the problems mentioned above and to achieve the object, a permanent magnet is provided which has a R-T-B based structure in which a R1-T-B based crystal layer (wherein, R1 represents at least one rare earth element except Y, and T represents at least one transition metal element containing Fe or the combination of Fe and Co as an essential) and a Y-T-B based crystal layer are stacked. With such a structure, a permanent magnet with excellent temperature properties and magnetic properties that will not significantly deteriorate compared to the conventional R-T-based permanent magnet can be achieved.

In the present invention, R includes R1 and Y. The use of Y can decrease the absolute value of the temperature coefficient. On the other hand, it will cause a problem that the magnetic anisotropy field is decreased. Thus, the inventors have found that the high magnetic anisotropy field of the R1-T-B based crystal layer can be maintained while the temperature coefficient of the Y-T-B based crystal layer can be improved, by stacking the R1-T-B based crystal layer and the Y-T-B based crystal layer. In this way, the present invention has been completed.

In the R-T-B based permanent magnet of the present invention, the atomic ratio of R1 to Y (i.e., R1/Y) preferably ranges from 0.1 to 10. By setting the atomic ratio to this range, a balance is achieved between the high magnetic anisotropy field of the R1-T-B based crystal layer and the improved temperature coefficient of the Y-T-B based crystal layer. Particularly, good magnetic properties can be achieved.

In the R-T-B based permanent magnet of the present invention, it is preferred that the thickness of the R1-T-B based crystal layer is 0.6 nm or more and 300 nm or less, and the thickness of the Y-T-B based crystal layer is 0.6 nm or more and 200 nm or less. By setting the thicknesses of these layers to these ranges, the coercivity inducement mechanisms from the single magnetic domains are also partially generated. Particularly, a high coercivity can be achieved.

In the present invention, a coercivity relatively higher than that in the R-T-B based permanent magnet using Y as R can be maintained by stacking the R1-Y-B based crystal layer and the Y-T-B based crystal layer in the R-T-B based permanent magnet with the addition of Y. Further, the absolute values of the temperature coefficients of the residual flux density and the coercivity can be lowered than that of the conventional R-T-B based permanent magnets using Nd, Pr, Dy, Ho or Tb as R.

BRIEF DESCRIPTION OF THE DRAWINGS

FIG. 1 shows the STEM-HAADF image of the cross section of the sample of Example 3.

DETAILED DESCRIPTION OF EMBODIMENTS

The ways for carrying out the present invention (embodiments) are described in detail. However, the present invention is not limited by the following embodiments. In addition, the elements described below may contain elements easily assumed by those skilled in the art and elements which are substantially the same. In addition, the elements described below can be appropriately combined.

The R-T-B based permanent magnet of the present embodiment contains 11 to 18 at % of rare earth elements. Here, the R in the present invention comprises R1 and Y as the essential ingredients. R1 represents at least one rare earth element except Y. If the amount of R is lower than 11 at %, the generation of the $R_2T_{14}B$ phase contained in the R-T-B based permanent magnet is not sufficient, the soft magnetic α-Fe and the like will precipitate, and the coercivity will be significantly reduced. On the other hand, if R is more than 18 at %, the volume ratio of the $R_2T_{14}B$ phase will decrease and the residual flux density will decrease. Further, as R reacts with O, while the amount of O contained therein increases, the R-rich phase effective in coercivity generation will decrease, resulting in the decrease of the coercivity.

In the present embodiment, the rare earth element R mentioned above contains R1 and Y. R1 represents at least one rare earth element except Y. Here, R1 could also contain other ingredients which are impurities derived from the starting material or impurities mixed during the production process. In addition, if a high magnetic anisotropy field is considered to be desired, R1 is preferred to be Nd, Pr, Dy, Ho and/or Tb. In view of the price of the starting materials and the corrosion resistance, Nd is more preferable.

The R-T-B based permanent magnet of the present embodiment contains 5 to 8 at % of B. If the amount of B is less than 5 at %, a high coercivity cannot be achieved. On the other hand, if the amount of B is more than 8 at %, the residual magnetic density tends to decrease. Thus, the upper limit of the amount of B is set to 8 at %.

The R-T-B based permanent magnet in the present embodiment may contain 4.0 at % or less of Co. Co forms a same phase as Fe, but it is effective in the improvement of the Curie temperature and the corrosion resistance of the grain boundary phase. Further, the R-T-B based permanent magnet in the present embodiment may contain 0.01 to 1.2 at % of one of Al and Cu or both. By containing one of Al and Cu or both in the mentioned range, high coercivity, high corrosion resistance and improved temperature characteristics of the resulted permanent magnet can be achieved.

The R-T-B based permanent magnet of the present embodiment is allowed to contain other elements. For example, elements such as Zr, Ti, Bi, Sn, Ga, Nb, Ta, Si, V, Ag, Ge and the like can be appropriately contained. On the other hand, it is preferred that the impurity elements such as O, N, C and the like are decreased to an extremely low level. Particularly, the amount of O, which damages the magnetic properties, is preferably 5000 ppm or less and more preferably 3000 ppm or less. This is because the phase of rare earth oxides as the non-magnetic ingredients will increase in volume if O is contained in a large amount, leading to lowered magnetic properties.

The R-T-B based permanent magnet of the present embodiment has an R-T-B based structure in which the R1-T-B based crystal layer and the Y-T-B based crystal layer are stacked. With the stacking of the R1-T-B based crystal layer and the Y-T-B based crystal layer, the temperature coefficient of the Y-T-B based crystal layer is improved while a high magnetic anisotropy field of the R1-T-B based crystal layer is maintained.

Here, the atomic ratio of R1 to Y (i.e., R1/Y) is preferably in the range of 0.1 or more and 10 or less. By setting the atomic ratio to this range, a balance is achieved between the high magnetic anisotropy field of the R1-T-B based crystal layer and the effect of improving the temperature coefficient of the Y-T-B based crystal layer. Particularly, high magnetic properties can be achieved. However, this atomic ratio is not limited such as when one layer is stacked on the surface and local improvement is aimed.

Further, the thickness of the R1-T-B based crystal layer is preferably 0.6 nm or more and 300 nm or less, and the thickness of the Y-T-B based crystal layer is 0.6 nm or more and 200 nm or less. With respect to the critical particle size in the single magnetic domain, it is about 300 nm of $Nd_2T_{14}B$ and about 200 nm of $Y_2Fe_{14}B$. Thus, by stacking each layer with a thickness equal to or thinner than the critical particle size respectively, the coercivity inducement mechanisms from the single magnetic domain are also partially generated from the nucleation type which is the general coercivity inducement mechanism in the R-T-B based permanent magnet. Thus, a high coercivity can be achieved. On the other hand, the interatomic distance in the c-axis direction is about 0.6 nm in the crystal structure of $R_2T_{14}B$. If the layer thickness is 0.6 nm or less, the stacked structure of the R1-T-B based crystal layer and the Y-T-B based crystal layer cannot be formed. If stacking is performed with a thickness smaller than 0.6 nm, a crystal structure of $R_2T_{14}B$ in which part of R1 and Y are randomly arranged will be obtained.

Hereinafter, the preferred examples of the production method in the present invention are described.

The methods for producing the R-T-B based permanent magnet include sintering, rapidly quenched solidification, vapor deposition, HDDR and the like. An example of the production method performed by sputtering in vapor deposition is described below.

As the material, the target materials are prepared first. The target materials are R1-T-B alloyed target material and Y-T-B alloyed target material with a desired composition. Here, as the sputtering yield of each element is different, there may be deviation between the composition ratio of the target materials and the composition ratio of the film formed by sputtering, and adjustment is needed. When a device with three or more sputtering means is used, single-element target materials for each of RI, Y, T and B may be prepared so as to perform the sputtering in desired ratios. Further, the sputtering may also be performed in desired ratios by using materials with a part of alloyed target materials such as R1, Y and T-B. Similarly, when other elements such as Zr, Ti, Bi, Sn, Ga, Nb, Ta, Si, V, Ag, Ge and the like are needed to be contained appropriately, they may also be contained by using the two methods involving the alloyed target materials and single-element target materials. On the other hand, the impurity elements such as O, N, C and the like are preferably reduced as much as possible, so the amount of the impurities contained in the target materials is also reduced as much as possible.

During storage, the target materials are oxidized from the surfaces. Particularly, the oxidation proceeds quickly when single-element target materials of rare earth elements such as R1and Y are used. Therefore, before the use of these target materials, sufficient sputtering is essential so as to expose their clean surfaces.

As for the base material which is film-formed by sputtering, various metals, glass, silicon, ceramics and the like can be selected to use. Since the treatment at a high temperature is essential to get a desired crystal structure, materials with high melting points are preferred. Furthermore, in addition to the resistance against the high-temperature treatment, as a measure to solve the problem that sometimes the adhesion to the R-T-B film is not sufficient, to improve the adhesion by providing a base film made of Cr or Ti, Ta, Mo and the like is usually performed. To prevent the oxidation of the R-T-B film, a protection film made of Ti, Ta, Mo and the like can be provided on the top of the R-T-B film.

With respect to the film-forming device for sputtering, since it is preferred that impurity elements such as O, N, C and the like are maximally decreased, the vacuum chamber is preferably evacuated to $10^{-6}$ Pa or less, more preferably $10^{-8}$ Pa or less. To keep a high vacuum state, a base material supply chamber which connects to the film-forming chamber is preferably provided. Then, since it is essential to perform sputtering sufficiently so as to expose the clean surfaces of the target materials before the use of the target materials, the firm-forming device preferably includes a shield means which can be operated under a vacuum state between the base materials and the target materials. As for the method for sputtering, in order to maximally decrease the amount of impurity elements, the method of magnetron sputtering which can be performed under Ar atmosphere with a lower pressure is preferred. Here, since the target materials containing Fe and Co could significantly decrease the leakage and the sputtering would be hard, it is necessary to choose a proper thickness of the target material. The power for sputtering can be any one of DC and RF, depending on the target materials.

In order to use the target materials and base materials mentioned above to prepare a stacked structure of the R1-T-B based crystal layer and the Y-T-B based crystal layer, the sputtering of the R1-T-B alloyed target material and that of the Y-T-B alloyed target material are alternatively performed. When the single-element target materials for each of R1, Y, T and B are used, the sputtering of the three target materials of R1, T and B is performed in a desired ratio followed by the sputtering of the three target materials of Y, T and B in a desired ratio. By repeating the sputtering alternatively, it is possible to obtain a stacked structure similar to that obtained by using the alloyed target materials. During the sputtering of the three target materials such as R1, T and B as well as Y, T and B, the sputtering can be performed by any one selected from simultaneous sputtering of three target materials and multilayer sputtering in which each element is sputtered individually. Even in the case of multilayer sputtering, the R-T-B based crystal structure is formed due to the thermodynamic stability by performing the stacking with proper ratios and thicknesses followed by heating. Further, the stacked structure can be prepared by transporting the base materials within the film-forming device to perform the sputtering of different target materials in separate chambers.

The number of the repetitions in the stacked structure can be set to any number of at least one set, wherein one set is obtained by stacking a R1-T-B based crystal layer and a Y-T-B based crystal layer.

The thickness of the R-T-B based crystal layer refers to that beginning from one end portion to the other end portion in the plane that R, Fe and B exist. The crystal structure of $R_2T_{14}B$ can be easily recognized because it is constructed by stacking the plane that R, Fe and B exist and the layer composed of Fe (referred to as the σ layer) in the c-axis direction.

The thicknesses of the R1-T-B based crystal layer and the Y-T-B based crystal layer in the stacked structure can be set to any thicknesses by adjusting the powder and process duration of the sputtering. By setting a difference between the thickness of the R1-T-B based crystal layer and that of the Y-T-B based crystal layer, the atomic ratio of the R1 to Y (R1/Y) can be adjusted. Further, it is also possible to provide a thickness gradient by varying the thicknesses in each repeat. Here, it is necessary to determinate the rate of film-forming in advance for the thickness adjustment. The determination of the rate of film-forming is performed by measuring the film formed with a predetermined power in a predetermined time using a touch-typed step gauge. Also, a crystal oscillator film thickness gauge provided in a film-forming device can be used.

In the sputtering, the base material is heated at 400 to 700° C. and crystallized accordingly. On the other hand, during the sputtering, it is also possible to crystallize the base material by maintaining the base material at room temperature and subjecting it to a thermal treatment at 400 to 1100° C. after the film formation. In this respect, the R-T-B film after film formation is usually composed of fine crystals of about a few tens of nanometers or amorphous substance, and the crystal grows by the thermal treatment. To reduce the oxidation and nitridation as much as possible, the thermal treatment is preferably performed under vacuum or inert atmosphere. For the same purpose, it is more preferably that the thermal treatment means and the film-forming device can be transported under vacuum. The thermal treatment is preferably performed in short time and it will be sufficient if the time is 1 minute to 1 hour. Also, the heating process in the film formation and the thermal treatment may be performed in any combination.

Here, the R1-T-B based crystal layer and the Y-T-B based crystal layer are crystallized by the energy from the sputtering and the energy from the heat to the base material. The energy from sputtering allows the sputtering particles attached to the base material and will disappear once the crystal forms. On the other hand, the energy from the heat to base material is provided continuously during film formation. However, with the thermal energy at 400 to 700° C., the diffusion of the R1-T-B based crystal layer and the Y-T-B based crystal layer barely proceeds so that the stacked structure is maintained. The same happens when crystallization proceeds in the thermal treatment after film formation at a low temperature. That is, the growth of the particles of fine crystal proceeds by the thermal energy at 400 to 1100° C., but the diffusion of the R1-T-B based crystal layer and the Y-T-B based crystal layer barely proceeds so that the stacked structure is maintained.

Although the stacked body produced in the present embodiment can be directly used as a film magnet as it is, it can also be further prepared to a rare earth based bond magnet or a rare earth based sintered magnet. The method of production will be described below.

An example of the production method for the rare earth based bond magnet will be described. First of all, the film made by sputtering with a stacked structure is peeled from the base material and then be subjected to fine pulverization. Thereafter, in the pressurized kneading machine such as the pressurized kneader, the resin binder containing resins as well as the main powders are kneaded, and the compound (composition) for rare earth based bond magnet are prepared, wherein the compound contains the resin binder and the powder of R-T-B based permanent magnet with a stacked structure. The resin includes thermosetting resins such as epoxy resin, phenolic resin and the like; or thermoplastic resins such as styrene-based, olefin-based, polyurethane-based, polyester-based, polyamide-based elastomers, ionomers, ethylene-propylene copolymer (EPM), ethylene-ethyl acrylate copolymer and the like. Of these, the resin used in compression molding is preferably the thermosetting resin and more preferably the epoxy resin or the phenolic resin. In addition, the resin used in injection molding is preferably the thermoplastic resin. Further, if desired, coupling agent or other additives can be added in the compound for the rare earth based bond magnet.

As for the ratio of the R-TB based permanent magnet powders and the resins contained in the rare earth based bond magnet, it is preferred that 0.5 mass % or more and 20 mass % or less of resins are contained based on 100 mass % of main powders. Based on 100 mass % of R-T-B based permanent magnet powders, if the amount of the resins is less than 0.5 mass %, the shape retention tends to be impaired. If the amount of the resins is more than 20 mass %, it tends to be hard to achieve magnetic properties excellent enough.

After the production of the compound for the rare earth based bond magnet, by subjecting the compound for the rare earth based bond magnet to injection molding, a rare earth based bond magnet with a stacked structure can be obtained which contains the R-TB based permanent magnet powders and resins, if the rare earth based bond magnet is prepared by injection molding, the compound for the rare earth based bond magnet is heated to the fusion temperature of the binder (the thermoplastic resin) and becomes flow state if needed. Then, the compound for the rare earth based bond magnet is subjected to the injection molding in a mold with a predetermined shape and molded. Then, after cooled down, the molded product (i.e., the rare earth based bond magnet) with a predetermined shape is taken out from the mold. In this way, a rare earth based bond magnet is obtained. The production method for the rare earth based bond magnet is not limited to the method of injection molding mentioned above. For example, the compound for the rare earth based bond magnet may also be subjected to the compression molding so as to obtain a rare earth based bond magnet containing the R-T-B based permanent magnet powders and resins. When the rare earth based bond magnet is produced by compression molding, after prepared, the compound for the rare earth based bond magnet is filled into a mold with a predetermined shape. After the application of pressures, the molded product (i.e., the rare earth based bond magnet) with a predetermined shape is taken out from the mold. In the process of the molding and take-out of the compound for the rare earth based bond magnet using a mold, it can be performed by using a compression molding machine such as a mechanical press or an oil-pressure press and the like. Thereafter, the molded product is cured by putting it into a furnace such as a heating furnace or a vacuum drying oven and applying heat, thereby a rare earth based bond magnet is obtained.

The shape of the molded rare earth based bond magnet is not particularly limited. Corresponding to the shape of the mold in use such as a tabular shape, a columnar shape and a shape with the section being circular, the shape of the rare earth based bond magnet vary accordingly. Further, with respect to the resulting rare earth based bond magnet, in order to prevent the oxidation layer, the resin layer and the like on the surface from deteriorating, the surface may be subjected to plating or coating.

When the compound for the rare earth based bond magnet is formed into the intended predetermined shape, the molded body derived from molding may also be oriented in a specific direction by applying a magnetic field. Thus, an anisotropic rare earth based bond magnet with better magnetic performances is obtained, as the rare earth based bond magnet is oriented in a specific direction.

An example of the production method of the rare earth based sintered magnet is described below. As mentioned above, the powders of the R-T-B based permanent magnet having a stacked structure are formed into an intended shape by compression molding or the like. The shape of molded body obtained by molding the powders of the R-T-B based permanent magnet with a stacked structure is not particularly limited. Corresponding to the shape of the mold in use such as a tabular shape, a columnar shape and a shape with the section being circular, the shape of the rare earth based sintered magnet vary accordingly.

Then, for example, a thermal treatment is applied to the molded body for 1 to 10 hours under vacuum or inert atmosphere at a temperature of 1000° C. to 1200° C. so as to perform the firing. Accordingly, a sintered magnet (a rare earth based sintered magnet) is obtained. After the firing, the resulting rare earth based sintered magnet is kept at a temperature lower than that during the firing, thereby an aging treatment is applied to these rare earth based sintered magnet. The treatment conditions of the aging treatment are appropriately adjusted depending on the times of applying the aging treatment. For example, the aging treatment may be a two-stage heating process in which heating is applied for 1 to 3 hours at 700° C. to 900° C. and then for 1 to 3 hours at 500° C. to 700° C.; or a one-stage heating process in which heating is performed for 1 to 3 hours at about 600° C. Such an aging treatment can improve the magnetic properties of the rare earth based sintered magnet.

The resulting rare earth based sintered magnet may be cut into desired sizes or the surfaces may be smoothed to be prepared to have a predetermined shape. Also, the resulting rare earth based sintered magnet may be subjected to plating or coating on the surfaces to prevent the oxidation layer or the resin layer or the like from deteriorating.

Furthermore, when the powders of the R-T-B based permanent magnet having a stacked structure is molded to have an intended predetermined shape, and the molded body may be oriented in a specific direction by applying magnetic field. Thus, an anisotropic rare earth based sintered magnet with better magnetic performance can be obtained as the rare earth based sintered magnet is oriented in a specific direction,

EXAMPLES

Hereinafter, the present invention will be specifically described by Examples and Comparative Examples. However, the present invention is not limited by the following Examples.

The target materials were prepared as the Nd—Fe—B alloyed target material, Pr—Fe—B alloyed target material and Y—Fe—B alloyed target material by adjusting the sputtering-formed films to the composition of $Nd_{15}Fe_{78}B_7$, $Pr_{15}Fe_{78}B_7$ and $Y_{15}Fe_{78}B_7$. The silicon substrate was prepared as the base material used for film formation. The conditions were set as follows. The target materials had a diameter of 76.2 mm, the size of the base material was 10 mm×10 mm, and the plane of the film was kept sufficiently uniform.

A device in which the gases can be evacuated to $10^{-8}$ Pa or less and a plurality of sputtering means were disposed in the same tank was used as the film-forming device. Then, in the film-forming device, the Nd—Fe—B alloyed target material, Pr—Fe—B alloyed target material, Y—Fe—B alloyed target material and Mo target material (which was used for the base film and the protection film) were provided. Sputtering was performed by the magnetron sputtering which used Ar atmosphere of 1 Pa and the RF generator. The power of the RF generator and the time for film formation were adjusted according to the composition of the samples.

In the film formation, Mo was formed to a film of 50 nm as the base film. Then, the thicknesses of the R1-Fe—B layer and the Y—Fe—B layer were adjusted according to each Example and Comparative Example and the sputtering was performed accordingly. The sputtering proceeded through two methods based on the composition of the samples. In one method the sputtering of two target materials was alternatively performed and in another method the sputtering of two target materials was performed simultaneously. After the formation of the R—Fe—B film, Mo was formed to a film of 50 nm as the protection film.

During the film formation, the silicon substrate (i.e., the base material) was heated to 600° C., so as to crystallize the R—Fe—B film. After the film formation of the magnetic layer, a protection film was formed at 200° C. and was taken out of the firm-forming device after it was cooled to room temperature under vacuum. The prepared samples were shown in Table 1.

TABLE 1

| | Species of R1 | Ratio of R1 to Y | Thickness of R1—Fe—B Layer (nm) | Thickness of Y—Fe—B layer (nm) | Number of Repetition (counts) | Film thickness of magnetic layer (nm) | Method for sputtering |
|---|---|---|---|---|---|---|---|
| Example 1 | Nd | 100.0:10.0 | 200.0 | 20.0 | 10 | 2200.0 | Sputtering of two target materials performed alternatively |
| Example 2 | Nd | 10.0:100.0 | 20.0 | 200.0 | 10 | 2200.0 | Sputtering of two target materials performed alternatively |
| Example 3 | Nd | 50.0:50.0 | 100.0 | 100.0 | 10 | 2000.0 | Sputtering of two target materials performed alternatively |
| Example 4 | Nd | 92.0:8.0 | 184.0 | 16.0 | 10 | 2000.0 | Sputtering of two target materials performed alternatively |
| Example 5 | Nd | 8.0:92.0 | 16.0 | 184.0 | 10 | 2000.0 | Sputtering of two target materials performed alternatively |
| Example 6 | Nd | 50.0:50.0 | 400.0 | 400.0 | 10 | 8000.0 | Sputtering of two target materials performed alternatively |
| Example 7 | Pr | 100.0:10.0 | 200.0 | 20.0 | 10 | 2200.0 | Sputtering of two target materials performed alternatively |
| Example 8 | Nd | 83.0:17.0 | 166.0 | 34.0 | 10 | 2000.0 | Sputtering of two target materials performed alternatively |
| Example 9 | Nd | 50.0:50.0 | 300.0 | 300.0 | 10 | 6000.0 | Sputtering of two target materials performed alternatively |
| Example 10 | Nd | 50.0:50.0 | 0.6 | 0.6 | 1500 | 1800.0 | Sputtering of two target materials performed alternatively |
| Example 11 | Nd | 50.0:50.0 | 0.4 | 0.4 | 2250 | 1800.0 | Sputtering of two target materials performed alternatively |
| Example 12 | Nd | 66.7:33.3 | 0.8 | 0.4 | 1500 | 1800.0 | Sputtering of two target materials performed alternatively |
| Example 13 | Nd | 99.2:0.8 | 100.0 | 0.8 | 20 | 2016.0 | Sputtering of two target materials performed alternatively |
| Example 14 | Nd | 50.0:50.0 | 100.0 | 100.0 | 5 | 1000.0 | Sputtering of two target materials performed alternatively |
| Comparative Example 1 | Nd | 100.0:10.0 | 2000.0 | 200.0 | — | 2200.0 | Sputtering of two target materials performed simultaneously |
| Comparative Example 2 | Nd | 10.0:100.0 | 200.0 | 2000.0 | — | 2200.0 | Sputtering of two target materials performed simultaneously |

After the evaluation of the magnetic properties, the prepared samples were subjected to the inductively coupled plasma atomic emission spectroscopy (ICP-AES) in which the atomic ratio was confirmed to be in accordance with the designs.

To investigate whether the prepared samples had the stacked structure of the Nd—Fe—B based crystal layer and the Y—Fe—B based crystal layer, an observation to the sections was performed. First of all, the samples were processed using a device of focused ion beam and then observed by a scanning transmission electron microscopy (STEM). Here, the observation could be performed with the heavy atom(s) as the focus by using the STEM-high angle annular dark field (HAADF) imaging. The sample from Example 3 was used and the result was shown in FIG. 1. It could be known from the figure that, by observing the crystal structure of $R_2Fe_{14}B$ in the [1-20] direction, the structure did contain the crystal structure of $R_2Fe_{14}B$. Here, B or Fe was the light atom and thus could not be clearly determined while the atomic images of Nd and Y could be seen. The atomic image with a bright contrast at the upper side of the figure could be determined to be Nd and the atomic image with a dark contrast at the lower side could be determined to be Y. In this respect, the presence of the stacked structure was confirmed. Furthermore, such a structure was also confirmed by the element analysis via X-ray energy dispersive spectroscopy (EDS).

The magnetic properties of each sample were measured using a vibrating sample magnetometer (VSM) by applying a ±4T magnetic field to the film's plane in a vertical direction. Table 2 showed the residual flux density, coercivity at 100° C. and the temperature coefficients thereof for the samples listed in Table 1.

TABLE 2

| | Temperature for test (° C.) | Br (mT) | Br (%/° C.) | HcJ (kA/m) | HcJ (%/° C.) |
|---|---|---|---|---|---|
| Example 1 | 100 | 1085 | −0.115 | 448 | −0.628 |
| Example 2 | 100 | 1047 | −0.106 | 415 | −0.621 |
| Example 3 | 100 | 1082 | −0.108 | 435 | −0.623 |
| Example 4 | 100 | 645 | −0.135 | 217 | −0.655 |
| Example 5 | 100 | 628 | −0.134 | 208 | −0.652 |
| Example 6 | 100 | 750 | −0.125 | 252 | −0.646 |
| Example 7 | 100 | 1081 | −0.116 | 450 | −0.631 |
| Example 8 | 100 | 1083 | −0.112 | 437 | −0.626 |
| Example 9 | 100 | 769 | −0.124 | 261 | −0.643 |
| Example 10 | 100 | 1076 | −0.108 | 431 | −0.622 |
| Example 11 | 100 | 723 | −0.125 | 240 | −0.646 |
| Example 12 | 100 | 760 | −0.124 | 257 | −0.643 |
| Example 13 | 100 | 636 | −0.135 | 209 | −0.655 |
| Example 14 | 100 | 1077 | −0.108 | 435 | −0.623 |
| Comparative Example 1 | 100 | 370 | −0.141 | 128 | −0.666 |
| Comparative Example 2 | 100 | 367 | −0.142 | 126 | −0.666 |

By comparing the Examples and Comparative Examples 1 and 2, it could be seen that the samples having R1-Fe—B based crystal layer and Y—Fe—B based crystal layer stacked had better magnetic properties and smaller absolute values of the temperature coefficients. This was because that by stacking the R1-Fe—B based crystal layer and the Y—Fe—B based crystal layer, the high magnetic anisotropy field of the R1-Fe—B based crystal layer could be maintained while the temperature coefficient of the Y—Fe—B based crystal layer could be improved.

Based on the comparison among Examples, it could be known that by rendering the atomic ratio of R1 to Y (i.e., R1/Y) within the range of 0.1 to 10, a balance was achieved between the high magnetic anisotropy field of the R1-Fe—B based crystal layer and the improved temperature coefficient of the Y—Fe—B based crystal layer. Particularly, better magnetic properties could be achieved.

By comparing the Examples, it could be known that the coercivity inducement mechanisms from the single magnetic domain were also partially generated when the thickness of the R1-Fe—B based crystal layer was 0.6 nm or more and 300 nm or less and the thickness of the Y—Fe—B based crystal layer was 0.6 nm or more and 200 nm or less. Particularly, better magnetic properties were achieved.

When Example 1 was compared with Example 7, it could be seen that the sample also had excellent magnetic properties and small absolute values of the temperature coefficients even if R1 was changed from Nd to Pr.

What is claimed is:

1. A R-T-B based permanent magnet, comprising
a R-T-B based structure in which a R1-T-B based crystal layer and a Y-T-B based crystal layer are stacked,
wherein R1 represents at least one rare earth element except Y, and T represents at least one transition metal element comprising Fe or a combination of Fe and Co.

2. The R-T-B based permanent magnet according to claim 1, wherein an atomic ratio of R1 to Y is 0.1 or more and 10 or less.

3. The R-T-B based permanent magnet according to claim 1, wherein said R1-T-B based crystal layer has a thickness of 0.6 nm or more and 300 nm or less, and said Y-T-B based crystal layer has a thickness of 0.6 nm or more and 200 nm or less.

4. The R-T-B based permanent magnet according to claim 2, wherein said R1-T-B based crystal layer has a thickness of 0.6 nm or more and 300 nm or less, and said Y-T-B based crystal layer has a thickness of 0.6 nm or more and 200 nm or less.

5. A R-T-B based film permanent magnet, comprising
a R-T-B based structure in which a R1-T-B based crystal layer and Y-T-B based crystal layer are stacked,
wherein R1 represents at least one rare earth element except Y, and T represents at least one transition metal element comprising Fe or a combination of Fe and Co.

6. The R-T-B based film permanent magnet according to claim 5, wherein an atomic ratio of R to Y is 0.1 or more and 10 or less.

7. The R-T-B based film permanent magnet according to claim 5, wherein said R1-T-B based crystal layer has a thickness of 0.6 nm or more and 300 nm or less, and said Y-T-B based crystal layer has a thickness of 0.6 nm or more and 200 nm or less.

8. The R-T-B based film permanent magnet according to claim 6, wherein said R1-T-B based crystal layer has a thickness of 0.6 nm or more and 300 nm or less, and said Y-T-B based crystal layer has a thickness of 0.6 nm or more and 200 nm or less.

9. A R-T-B based permanent magnet powder, comprising
a R-T-B based structure in which a R1-T-B based crystal layer and a Y-T-B based crystal layer are stacked,
wherein R1 represents at least one rare earth element except Y, and T represents at least one transition metal element comprising Fe or a combination of Fe and Co.

10. The R-T-B based permanent magnet powder according to claim 9, wherein an atomic ratio of R1 to Y is 0.1 or more and 10 or less.

11. The R-T-B based permanent magnet powder according to claim 9, wherein said R1-T-B based crystal layer has a thickness of 0.6 nm or more and 300 nm or less, and said Y-T-B based crystal layer has a thickness of 0.6 nm or more and 200 nm or less.

12. The R-T-B based permanent magnet powder according to claim 10, wherein said R1-T-B based crystal layer has a thickness of 0.6 nm or more and 300 nm or less, and said Y-T-B based crystal layer has a thickness of 0.6 nm or more and 200 nm or less.

13. A bond magnet comprising the R-T-B based permanent magnet powder of claim 9.

14. A bond magnet comprising the R-T-B based permanent magnet powder of claim 10.

15. A bond magnet u comprising the R-T-B based permanent magnet powder of claim 11.

16. A bond magnet comprising the R-T-B based permanent magnet powder of claim 12.

17. A sintered magnet comprising the R-T-B based permanent magnet powder of claim 9.

18. A sintered magnet comprising the R-T-B based permanent magnet powder of claim 10.

19. A sintered magnet comprising the R-T-B based permanent magnet powder of claim 11.

20. A sintered magnet comprising the R-T-B based permanent magnet powder of claim 12.

* * * * *